US007938621B1

(12) United States Patent
Balsdon et al.

(10) Patent No.: US 7,938,621 B1
(45) Date of Patent: May 10, 2011

(54) BLADE TIP CLEARANCE SYSTEM

(75) Inventors: Julian G Balsdon, Bristol (GB); Sean A Walters, Bristol (GB)

(73) Assignee: Rolls-Royce PLC, London (GB)

( * ) Notice: Subject to any disclaimer, the term of this patent is extended or adjusted under 35 U.S.C. 154(b) by 1826 days.

(21) Appl. No.: 09/184,402

(22) Filed: Oct. 28, 1998

(30) Foreign Application Priority Data

Dec. 3, 1997 (GB) ..... 9725623.4

(51) Int. Cl.
*F01D 11/20* (2006.01)

(52) U.S. Cl. ..... 415/173.1

(58) Field of Classification Search .... 415/173.1–173.5, 415/139, 173.6
See application file for complete search history.

(56) References Cited

U.S. PATENT DOCUMENTS 4,551,064 A * 11/1985 Pask ..... 415/173.3
5,088,888 A 2/1992 Bobo
5,374,161 A 12/1994 Kelch et al.
5,375,973 A 12/1994 Sloop et al.
5,641,267 A * 6/1997 Proctor et al. ..... 415/173.1
5,871,333 A * 2/1999 Halsey ..... 415/173.1

FOREIGN PATENT DOCUMENTS

GB 1484288 * 9/1977 ..... 415/173.1
GB A-2169962 7/1986
GB A-2313414 11/1997

* cited by examiner

*Primary Examiner* — Timothy D Collins
*Assistant Examiner* — Joseph W Sanderson
(74) *Attorney, Agent, or Firm* — Oliff & Berridge, PLC

(57) ABSTRACT

A pressure actuated tip clearance system for a shroud structure of a gas turbine engine rotary stage includes an annular plenum chamber formed between an annular arrangement of a plurality of shroud liners on the inner circumference of the chamber and a generally cylindrical casing on the radially outer side, and, in use, a hot gas stream radially inwards of the shroud liners. Each shroud liner comprises a hollow box section comprising upstream and downstream walls, radially inner and outer walls, and side walls, the downstream and radially inner and outer walls being closed, the upstream wall having an air inlet aperture, and at least one of the side walls having at least one outlet aperture. The inlet aperture is in flow communication with a source of high pressure air at a pressure higher than that of the gas stream.

10 Claims, 2 Drawing Sheets

BLADE TIP CLEARANCE SYSTEM

This invention relates to improvements in a blade tip clearance system for a rotary stage of a gas turbine engine. In particular, the invention concerns improvements in a blade tip clearance system for a turbine stage and which is driven by fluid pressure in an internal air cooling system associated with the stage.

Our published UK patent specification GB 2169962A discloses a tip clearance control system that uses fluid pressure. In this arrangement, a movable diaphragm member supports shroud liner segments of a compressor rotary stage. Behind the diaphragm member is a chamber. Pipe work connects the chamber to a valve that connects the chamber alternatively with a source of fluid pressure or vents the chamber to a low pressure region. Thus, displacement of the diaphragm, by controlling the pressure in the chamber, moves the shroud liner segments. However, the additional pipe work and diaphragm add weight and introduce other components with their own associated risks of failure.

In our co-pending application GB 2,313,414 there is described a "two-stop" tip clearance control system operated by differential air pressure. Such a control system has an annular arrangement of movable shroud liner segments which forms the inner circumference of an annular pressure chamber encircling the blades of a rotary stage. For minimum tip clearance high pressure air is bled into the chamber from a source of high pressure compressor delivery air through small bleed or metering holes so the shroud liner segments are urged towards their minimum clearance stops. The chamber may be vented rapidly through an electrically controlled dump valve into the engine bypass duct. When the valve is opened, pressure in the chamber drops quickly below gas path pressure to move the shroud liner segments radially outwards to the maximum clearance stops, thereby increasing blade tip clearance. In this system, during engine operation, fluid (ie air from the internal air cooling system) is bled continuously into the plenum chamber through the small-metering holes. The fluid will usually be drawn from a source of high pressure compressor delivery air. In this kind of arrangement the position of the shroud liner segments is controlled by the same air used to cool them, so that when pressure in the annular control chamber is dumped to increase tip clearance cooling efficiency may be reduced temporarily by the lowered pressure. Inter-segment gap leakage flow is also reduced at a time when it is less convenient.

The present invention seeks to provide improvements to the above system whereby hot gas ingestion into the plenum chamber is minimised when the plenum chamber is at a low pressure, especially under extreme performance conditions such as slow acceleration. This is particularly important if the valve and actuation system are designed to fail in an open configuration.

According to the present invention there is provided a pressure actuated tip clearance system for a shroud structure of a gas turbine rotary stage including an annular plenum chamber formed between an annular arrangement of a plurality of shroud liners on the inner circumference of the chamber and a generally cylindrical casing on the radially outer side, and, in use, a hot gas stream located radially inwards of the shroud liners, wherein each shroud liner comprises a hollow box section comprising upstream and downstream walls, radially inner and outer walls, and side walls, the downstream wall and radially inner and outer walls being closed, the upstream wall having an air inlet aperture, and at least one of the side walls having at least one outlet aperture, and the inlet aperture is in flow communication with a source of high pressure air at a pressure higher than that of the hot gas stream.

The invention will now be described by way of example only with reference to the accompanying schematic drawings, in which.

It will be understood that the drawings are not to scale and that, in particular, the depiction of the gaps between facing surfaces has been exaggerated in the interest of clarity.

Figure 1:
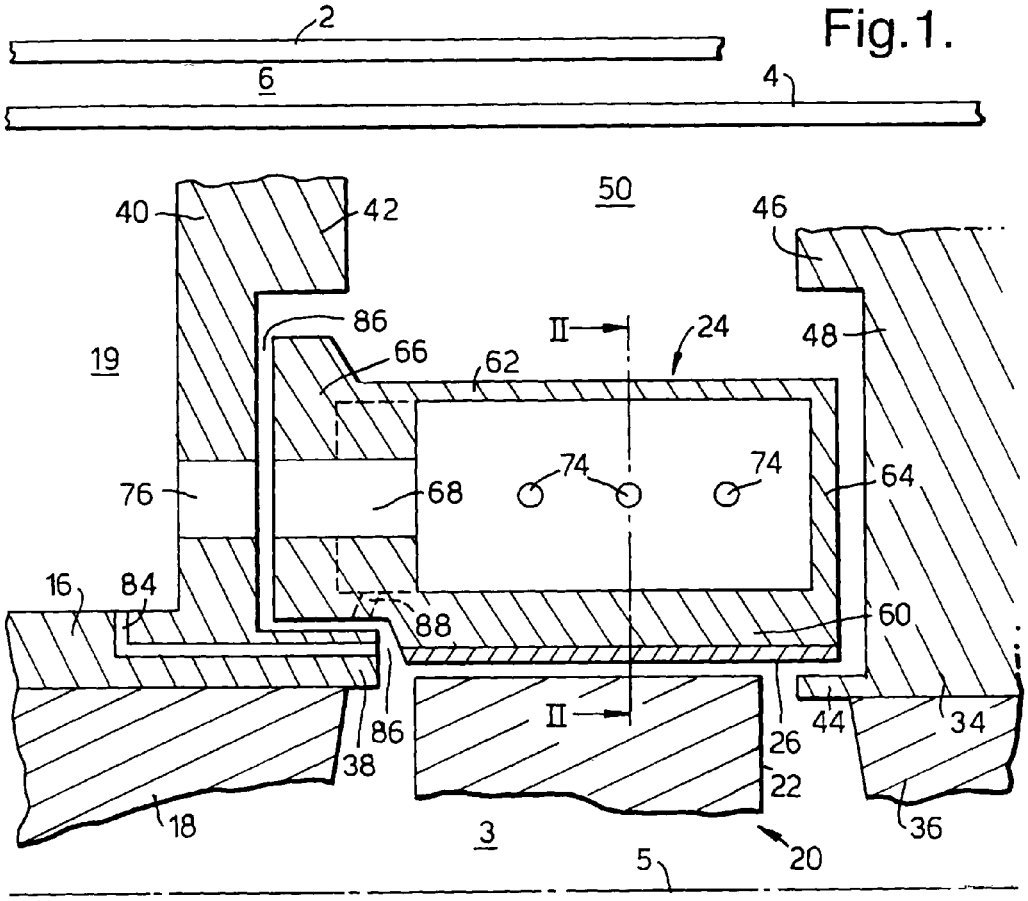
FIG. 1 is a radial section through a shroud liner arrangement of a turbine stage of a gas turbine engine according to the invention.

Referring now to FIG. 1, there is shown a radial view through part of the first, high pressure turbine stage of a bypass gas turbine aeroengine. A section of a generally cylindrical engine outer casing is indicated schematically at 2, and an adjacent section of a concentric inner casing, likewise schematically, at 4. An annular space 6 between the outer and inner casings 2,4 constitutes the engine bypass duct. On the left (upstream) side of FIG. 1 is shown part of an upstream nozzle guide vane 18 extending radially across a hot gas path 3 between an outer vane platform 16 and a concentric inner vane platform (not shown). As will be understood, the illustrated guide vane 18 is one of a series of guide vanes extending radially between the concentric vane platforms and which together with the platforms form the outlet nozzle guide vane annular. The inner surfaces (ie those facing into the gas flow 3) of the vane platforms are smooth-flow walls.

An annular volume 19 formed by the space between the outer vane platform 16 and the inner casing 4 constitutes a chamber which opens into the high pressure casing surrounding the engine combustion chamber. The air in annular volume 19 is always at a higher pressure than the gas stream.

Downstream of the outlet nozzle guide vane annulus is a high pressure turbine rotary, stage 20 consisting of an annular array of shroudless turbine blades 22 (only one of which is shown in part) mounted on a disc (not shown). Encircling the array of turbine blades 22 is an annular arrangement consisting of a plurality of shroud liner segments 24 (only one of which is shown) mounted in side by side abutment in a circumferential direction. Each shroud liner segment 24 carries on its radially inner face a layer 26 of abradable material into which the tips of the blades 22 can wear a track, or groove, in the event of a transient tip rub occurring. The construction of the shroud liner segment 24 will be described in more detail hereinafter.

Downstream of the turbine blades 22 in the gas path 3 is a second annular array of guide vanes 36 (only one of which is shown) extending radially between an outer vane platform 34 and an inner vane platform (not shown), and spaced apart in a circumferential direction.

In an assembled arrangement, upstream and downstream circumferential edges of the shroud liner segment 24 are supported by portion of the guide vane outer platforms 16,34 respectively. Specifically, the upstream outer platform 16 has a trailing edge 38 which extends downstream and acts as a stop for the upstream circumferential edge of the shroud liner segment 24. The downstream outer platform 34 likewise has an upstream extending margin 44 which acts as a stop for the downstream circumferential edge of the shroud liner segment 24. The stops 38,44 thus constitute the radially inner, or minimum clearance, stops in a two-stop tip clearance control system.

A short distance upstream from trailing edge 38 is formed an upstanding circumferential flange 40 which extends radially outwards from the vane platform 16 towards the inner engine casing 4 and also forms the downstream containing wall for the annular volume 19. At a height intermediate between the outer platform 16 and the inner engine casing 4 the flange 40 is provided on its downstream side with an axially extending projection or stop 42 which is thus parallel to but spaced from the guide vane trailing edge 38. Similarly, a short distance downstream from margin 44 of outer vane platform 34 there is formed an upstanding circumferential flange 48 extending radially outwards from platform 34 and provided at an intermediate height on its upstream side with an axially extending projection or stop 46 which is thus parallel to but spaced from the margin 44. The second pair of stops 42,46 thus constitute the radially outer, or maximum clearance, stops of the two-stop system. Hence, the liner segment 24 is restrained in its radial movement by the pairs of stops 38,42 and 44,46. The liner segments 24 constitute a movable inner wall of an annular plenum chamber 50 which is bounded radially by the liner segments and the inner engine casing 4. The radial movement of the shroud liner segments 24 in response to thermal and centrifugal changes in radial dimension of the turbine blades 22 may be controlled by means known in the art for example as described in our earlier application GB 2,313,414 mentioned above. Those parts of the system which are common will be readily appreciated but as they are outside the scope of the present invention will not be further described or illustrated.

The detail structure and operation of the basic shroud liner segment 24 cooling system will now be described with reference to FIGS. 1 and 2.

Each shroud liner segment 24 is provided with a cuboid box structure consisting of inner and outer part-annular walls 60,62 a solid downstream wall 64, an upstream wall 66, having therein at least one aperture 68 (two are in fact shown in FIG. 2) and side walls 70,72. The upstream wall apertures 68 provide flow communication between the volume 19 and the interior of box liner segment 24. The side walls 70,72 of the box liner segment 24 also have at least one aperture 74 (three are shown in FIG. 1) providing flow communication between the interior of the liner segment and a small gap 78 between adjacent box liners.

The circumferential flange 40 is provided with a series of axial apertures 76, each in approximate axial alignment with a corresponding aperture 68 in the shroud liner segment 24, thus enabling relatively cool high pressure compressor air to pass from the annular volume 19 through the apertures 68 into the interior of the box liners. This air then exits the interior of box liner segment 24 through aperture(s) 74 into the inter-liner gaps 78. The cross-sections of apertures 76 and 68 will be chosen so that despite the radial position of the shroud liner segment 24 there will be a sufficient overlap between the apertures 76 and 68 for high pressure compressor air to flow therethrough. The rate at which air exits the box liners is determined, ie metered, by the exit apertures 74.

Figure 2:
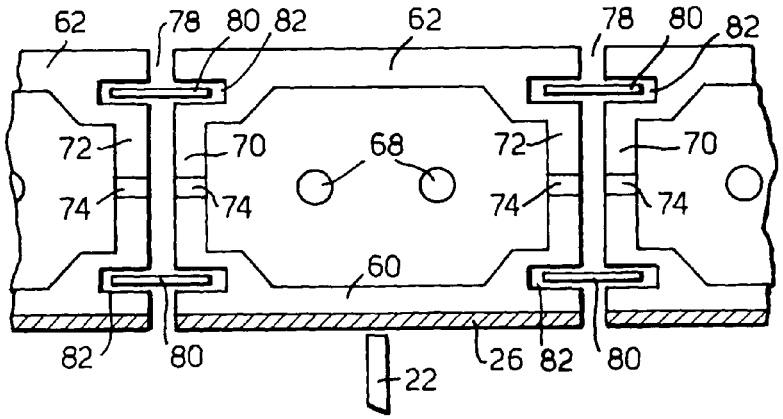
FIG. 2 is an axial view on line II-II of FIG. 1.

In FIG. 2, the shroud liner segments 24 are shown circumferentially adjacent, separated by the radial gaps 78 into which the apertures 74 open. Some measure of sealing of these radial gaps 78 is effected by elongate seal strips 80 which insert into longitudinal slots 82 in walls 70 and 72 extending substantially the axial width of the shroud liner segment 24. However, perfect sealing is not attainable because there will be movement of the sealing strips 80 in the slots 82 due to relative radial movements of the shroud liner segment 24. Incursion of hot, high pressure gas from the gas stream 3 into the radial gaps 78 into the relatively lower pressure plenum chamber 50 is inhibited by the leakage flow from the apertures 74. Some of this relatively cool air will also leak into the plenum chamber 50, and some into the gas stream 3 providing cooling and protection for the edges of the components.

Small bleed holes 84 leading from annular volume 19 through the outer vane platform 16 to a clearance gap 86 between the upstream face of a radially inner portion of the shroud liner 24 and the trailing edge 38 of the vane platform provide cooling and protection for these parts. There exists a permanent pressure gradient between the annular volume 19 and the gas path 3, and this will drive a flow of cooler air through holes 84 into the clearance gap 86 and thus provide a shield against incursion of hot gas from the gas path 3 past the shroud liner 24 into the plenum chamber 50.

There may be also provided bleed holes 88 leading from the interior of the shroud liner 24 to a radially outer portion of the clearance gap 86. Some of the cool high pressure compressor air that has passed into the shroud liner 24 from the annular volume 19 will escape through the bleed holes 88 and assist in providing a shield against the incursion of hot gas from the gas path 3 into the plenum chamber 50. The gap 86 however extends over the whole area of the upstream side of the box shroud liner between the upstream wall 66 and the guide vane flange 40. In the particular arrangement of FIG. 1 there provides a potential uncontrolled leakage path for the loss of cooling air.

Figure 3:
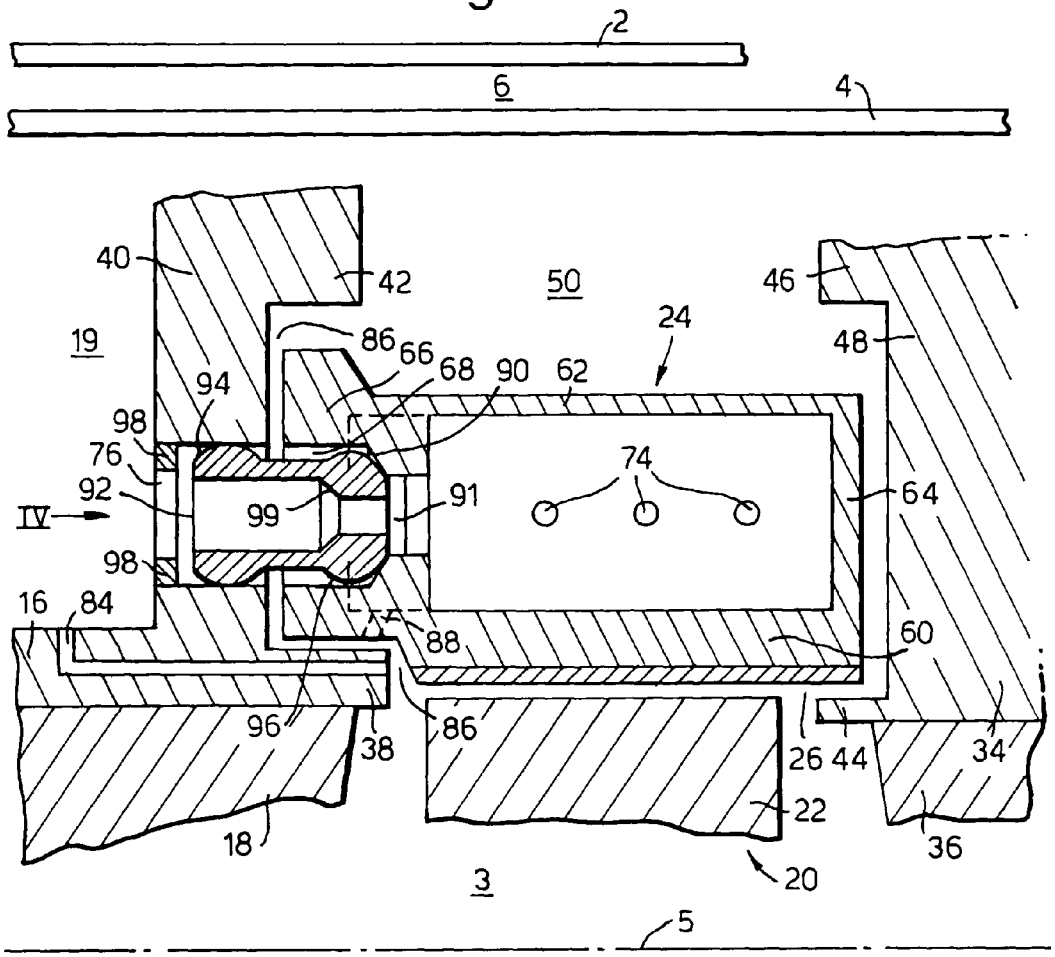
FIG. 3 is a radial section through an alternative shroud liner arrangement of a turbine stage of a gas turbine engine, similar to that of FIG. 1, but further showing a transfer means for delivering high pressure compressor delivery air to the shroud liner arrangement.

Referring now generally to FIG. 3 there is shown an alternative shroud liner arrangement in which features common to FIGS. 1 and 2 have the same numbering.

Figure 4:
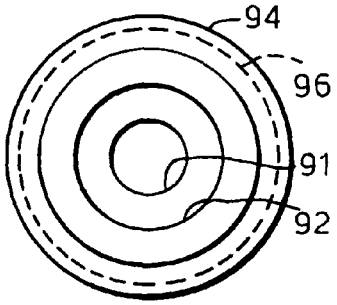
FIG. 4 is an end view of the transfer means of FIG. 3 taken in the direction of arrow IV.

In this improved arrangement uncontrolled leakage through the gap 86 is eliminated. Aperture 68 in wall 66 of shroud liner 24 has a frusto-conical section 90 at its downstream end, of tapering cross-section in the downstream direction to a narrow exit 91 into the interior of the shroud liner. Located within aperture 68 in the shroud liner 24 and aperture 76 in flange 40 is a transfer tube 92 which spans the radial gap 86 between the shroud liner and the flange. Transfer tube 92 is of generally cylindrical construction with part-spherical ends provided by externally radiused circumferential flanges 94,96 at either end, as can also be seen from the end view of the transfer tube 92 in FIG. 4. Flange 94 at the upstream end of the transfer tube engages the interior of aperture 76, and flange 96 at the downstream end engages the frusto-conical surface 90. Because the circumferential flanges 94,96 are radiussed, they roll against the respective interior surfaces of apertures 76 and 68 as the shroud liner 24 moves, in use, in relation to static components such as flange 40. This provides the transfer tube with six degrees of freedom, and it is self-compensating for any wear which takes place.

The transfer tube 92 thus reduces uncontrolled leakage flow and is a more efficient means for transferring high pressure compressor air from the annular volume 19 to the interior of the shroud liner 24 under all relative dispositions of the box shroud liner with respect to the flange 40.

Aperture 76 in flange 40 is provided at its upstream end (ie the opening into the annular volume 19) with a radially inwardly directed circumferential retaining flange 98 which acts to limit axial movement of the transfer tube 92 in the upstream direction. Axial movement of the transfer tube 92 in the downstream direction is of course limited by the tapering section 90 of aperture 68.

The transfer tube 92 is also provided with a tapering internal section 99 at its downstream end so as to ensure an efficient flow of air from the transfer tube through the exit 91 into the interior of the shroud liner 24.

There may be two or more transfer tubes 92 per shroud liner 24 which engage corresponding apertures in the guide vane flange 40 and liner wall 66.

In addition to the high pressure air from annular volume 19 cooling the box shroud liner 24, leakage air from apertures 74 and 88 provides a shield against incursion of hot gas from the gas stream 3 past the shroud liner into the plenum chamber 50.

In some embodiments it may be considered sufficient to have one or more apertures 74 in only one of the sides 70,72 of each shroud liner 24. In a further possible embodiment (not illustrated) the transfer tube 92 may have a flexible (eg corrugated) intermediate structure enabling it to be fixed at either or both its ends to aperture 76 or to inlet 68.

What is claimed is:

1. A pressure actuated tip clearance system for a shroud structure of a gas turbine rotary stage including an annular plenum chamber formed between an annular arrangement of a plurality of shroud liners on the inner circumference of the chamber and a generally cylindrical casing on the radially outer side, and, in use, a hot gas stream located radially inwards of the shroud liners, wherein each shroud liner comprises a hollow box section comprising upstream and downstream walls, radially inner and outer walls, and side walls, at least the downstream wall and the radially outer wall being closed, the upstream wall having an air inlet aperture, and at least one of the side walls having at least one outlet aperture, and a means for flow communication providing flow communication between the inlet aperture and a source of high pressure air at a pressure higher than that of the hot gas stream.

2. A tip clearance system as claimed in claim 1 wherein the means for flow communication includes an aperture in a wall enclosing high pressure air, said aperture being adjacent to and in at least approximate alignment with the inlet aperture.

3. A tip clearance system as claimed in claim 2 wherein there is provided an air transfer tube between the aperture in the wall enclosing the high pressure air and the inlet to the shroud liner, the transfer tube being arranged to move in response to radial movement of the shroud liner.

4. A tip clearance system as claimed in claim 3 wherein the air transfer tube comprises a cylindrical structure having its upstream end inserted into the aperture in the wall enclosing the high pressure air and its downstream end inserted in the inlet to the shroud liner, the inlet to the shroud liner having a frusto-conical section tapering downstream, and the transfer tube being provided at both ends with external circumferential radiussed flanges, the upstream flange being in rolling contact with the wall of said aperture and the downstream flange being in rolling contact with the frusto-conical section of said inlet, whereby the transfer tube is able to move with several degrees of freedom in response to radial movement of the shroud liner.

5. A tip clearance system as claimed in claim 1 wherein the source of high pressure air is a high pressure compressor air delivery system.

6. A tip clearance system as claimed in claim 1 wherein the at least one outlet aperture is directed into a radial gap between two adjacent shroud liners so that high pressure air within the shroud liner, in use, exits through said outlet aperture and inhibits hot gas from passing radially outwards between the shroud liners into the plenum chamber.

7. A tip clearance system as claimed in claim 1 wherein circumferentially adjacent shroud liners are linked by one or more seal strips extending across a radial gap between adjacent shroud lines, each seal strip being housed at each end in a slot in a side wall of a said shroud liner, the housing in the slots being arranged to permit relative radial movement of adjacent shroud liners.

8. A tip clearance system as claimed in claim 1 wherein there is further provided a bleed aperture leading from the interior of the shroud liner to a radial clearance gap immediately upstream of the shroud liner and extending from the gas stream to the plenum chamber, whereby, in use, high pressure air from within the shroud liner exits through the bleed aperture and inhibits the passage of hot gas from the gas stream into the plenum chamber.

9. A tip clearance system as claimed in claim 8 wherein there is provided a high pressure bleed system leading from the source of high pressure air to said radial clearance gap, whereby, in use, high pressure air bleeds into the clearance gap and inhibits the passage of hot gas from the gas stream into the plenum chamber.

10. A tip clearance system as claimed in claim 1 wherein there is provided a high pressure bleed system leading from the source of high pressure air to a radial clearance gap immediately upstream of the shroud liner and extending from the gas stream to the plenum chamber whereby, in use, high pressure air bleeds into the clearance gap and inhibits the passage of hot gas from the gas stream into the plenum chamber.

* * * * *